US008204237B2

(12) United States Patent
Goodwin

(10) Patent No.: US 8,204,237 B2
(45) **Date of Patent: *Jun. 19, 2012**

(54) ADAPTIVE PRIMARY-AMBIENT DECOMPOSITION OF AUDIO SIGNALS

(75) Inventor: Michael M. Goodwin, Scotts Valley, CA (US)

(73) Assignee: Creative Technology Ltd, Singapore (SG)

( * ) Notice: Subject to any disclaimer, the term of this patent is extended or adjusted under 35 U.S.C. 154(b) by 474 days.

This patent is subject to a terminal disclaimer.

(21) Appl. No.: 12/416,099

(22) Filed: Mar. 31, 2009

(65) Prior Publication Data

US 2009/0252341 A1 Oct. 8, 2009

Related U.S. Application Data

(63) Continuation-in-part of application No. 12/048,156, filed on Mar. 13, 2008, which is a continuation-in-part of application No. 11/750,300, filed on May 17, 2007.

(60) Provisional application No. 61/041,181, filed on Mar. 31, 2008, provisional application No. 60/747,532, filed on May 17, 2006, provisional application No. 60/894,650, filed on Mar. 13, 2007.

(51) Int. Cl.
*H04R 29/00* (2006.01)

(52) U.S. Cl. ..... 381/56; 381/307

(58) Field of Classification Search ..... 381/56
See application file for complete search history.

(56) References Cited

U.S. PATENT DOCUMENTS

| | | | | |
|---|---|---|---|---|
| 7,412,380 | B1 * | 8/2008 | Avendano et al. | 704/216 |
| 7,853,022 | B2 * | 12/2010 | Thompson et al. | 381/17 |
| 2007/0242833 | A1 * | 10/2007 | Herre et al. | 381/61 |
| 2007/0269063 | A1 * | 11/2007 | Goodwin et al. | 381/310 |
| 2008/0175394 | A1 * | 7/2008 | Goodwin | 381/1 |
| 2009/0198356 | A1 * | 8/2009 | Goodwin et al. | 700/94 |
| 2010/0296672 | A1 * | 11/2010 | Vickers | 381/119 |

OTHER PUBLICATIONS

Goodwin, M.M. et al., "Primary-Ambient Signal Decomposition and Vector Based Localization for Spatial Audio Coding and Enhancement, " IEEE ICASSP 2007, vol. 1, Apr. 15-20, 2007.

* cited by examiner

*Primary Examiner* — Benjamin Sandvik
(74) *Attorney, Agent, or Firm* — Creative Technology Ltd

(57) ABSTRACT

A stereo audio signal is processed to determine primary and ambient components by transforming the signal into vectors corresponding to subband signals, and decomposing the left and right channel vectors into ambient and primary components by matrix and vector operations. Principal component analysis is used to determine a primary component unit vector, and ambience components are determined according to a correlation-based cross-fade or an orthogonal basis derivation.

15 Claims, 6 Drawing Sheets

(a)

(b)

(c)

ADAPTIVE PRIMARY-AMBIENT DECOMPOSITION OF AUDIO SIGNALS

CROSS-REFERENCE TO RELATED APPLICATION

This application claims the benefit of U.S. Provisional Patent Application Ser. No. 61/041,181, filed on Mar. 31, 2008, and entitled "Adaptive Primary-Ambient Decomposition of Audio Signals, and is a continuation-in-part of U.S. patent application Ser. No. 12/048,156, filed on Mar. 13, 2008, and entitled "Vector-Space Methods for Primary-Ambient Decomposition of Stereo Audio Signals", which claims the benefit of U.S. Provisional Patent Application Ser. No. 60/894,650, filed on Mar. 13, 2007, and entitled "Vector-Space Methods for Primary-Ambient Decomposition of Stereo Audio Signals", and which is a continuation-in-part of U.S. patent application Ser. No. 11/750,300, filed May 17, 2007, and entitled "Spatial Audio Coding Based on Universal Spatial Cues", which claims the benefit of U.S. Provisional Patent Application Ser. No. 60/747,532, filed on May 17, 2006, all of the disclosures of which are incorporated by reference in their entirety for all purposes herein.

BACKGROUND OF THE INVENTION

1. Field of the Invention

The present invention relates to audio signal processing techniques. More particularly, the present invention relates to methods for decomposing audio signals into primary and ambient components.

2. Description of the Related Art

Primary-ambient decomposition algorithms separate the reverberation (and diffuse, unfocussed sources) from the primary coherent sources in a stereo or multichannel audio signal. This is useful for audio enhancement (such as increasing or decreasing the "liveliness" of a track), upmix (for example, where the ambience information is used to generate synthetic surround signals), and spatial audio coding (where different methods are needed for primary and ambient signal content).

Current methods determine ambience components for each audio channel by applying a real-valued multiplier to the original channel signal, such that the resulting primary and ambient components for each channel are in phase. Unfortunately, these techniques sometimes lead to artifacts in the audio reproduction. These artifacts include the "leakage" of primary components into the ambience, etc. What is desired is an improved primary-ambient decomposition technique.

SUMMARY OF THE INVENTION

The invention describes techniques that can be used to avoid such artifacts as the "leakage" of coherent sources into the estimated ambience component. The invention provides new methods for decomposing a stereo audio signal or a multichannel audio signal into primary and ambient components. Post-processing methods for enhancing the decomposition are also described.

The present invention provides methods for separating stereo audio signals into primary and ambient components. According to several embodiments, a vector-space primary-ambient decomposition is performed. The primary and ambient components are derived such that the sum of the primary and ambient components equals the original signal and various desired orthogonality conditions are satisfied between the components. In preferred embodiments, the input audio signals are each filtered into subbands; these subband signals are then treated as vectors and are decomposed into primary and ambient components using vector-space methods. One advantage of these embodiments is that less tuning of algorithm parameters is required than in previously described methods.

Embodiments of the current invention can operate directly on the time-domain audio signals. In preferred embodiments, however, the incoming stereo audio signal is initially converted from a time-domain representation to a frequency-domain or subband representation. In one method for converting to the frequency domain, commonly referred to as the short-time Fourier transform (STFT), each channel of the stereo audio signal is windowed to generate frames or segments of sound and a Fourier Transform is performed on the windowed signal frames to generate a frequency-domain representation of the signal content in each frame; the window function removes from the current processing focus all but a short-time interval of the time-domain signal. The frames are spaced at a regular offset known as the hop size. The hop size determines the overlap between the frames. The application of the STFT results in the distribution of the transformed signal over a plurality of frequency bins or subbands. For each signal window or frame, each bin contains magnitude and phase values for the channel signal in that frame; a time sequence for each particular bin, corresponding to a sequence of prior signal windows, is analyzed to separate the respective bin's signal content for the current time into primary and ambient components. This proportional allocation of primary and ambient components is based on vector-space operations. An inverse transform is applied to the resulting primary and ambient signal content to generate the respective primary and ambience time-domain signals.

In several embodiments, the respective channel signals are decomposed into primary and ambient components in order to satisfy selected orthogonality constraints. The audio signals and signal components are treated as vectors to enable the application of vector and matrix mathematics and to facilitate the use of diagrams to illustrate the operation of the various embodiments.

According to various embodiments, a principal components analysis (PCA), which can be equivalently referred to as "principal component analysis" (where "component" is singular), having a novel closed-form solution is provided such that iteration is not required to generate the primary and ambient components. A principal direction for the primary component is established preferably by first determining the dominant eigenvalue of the channel signal's correlation matrix, and then identifying the corresponding eigenvector as the principal direction. This principal direction vector is found as a weighted average of the right and left channel vectors. The primary components are found as orthogonal projections onto the principal direction vector, and the ambience components are found as the corresponding projection residuals. The resulting primary components are fully correlated (collinear in signal space). The resulting ambience components are also collinear and are not orthogonal across the channels.

An aspect of the present invention provides a method for processing a multichannel audio signal to determine primary and ambient components of the signal. The method includes: converting each channel of the multichannel audio signal to corresponding subband vectors, wherein the vectors comprise a time sequence or history of the channel signal's behavior in corresponding subbands; determining a primary component unit vector for each subband; determining primary component vectors for each audio channel in each subband by projecting the channel subband vector onto the primary component unit vector; determining the ambience component vector for each channel in each frequency subband as the projection residual; and adjusting the balance between the primary and ambient vectors to generate modified primary and ambient components.

Another aspect of the present invention provides a method for processing a multichannel audio signal to determine primary and ambient components of the signal. The method includes: converting each channel of the multichannel audio signal to corresponding subband vectors, wherein the vectors comprise a time sequence or history of the channel signal's behavior in corresponding subbands; determining ambience unit vectors for each channel and each subband after forming an orthogonal basis for the signal subspace defined by the corresponding channel subband vectors; determining a primary component unit vector for each subband; and decomposing the subband vector for each channel using the corresponding ambience unit vector and the primary unit vector.

These and other features and advantages of the present invention are described below with reference to the drawings.

DETAILED DESCRIPTION OF PREFERRED EMBODIMENTS

Figure 1:
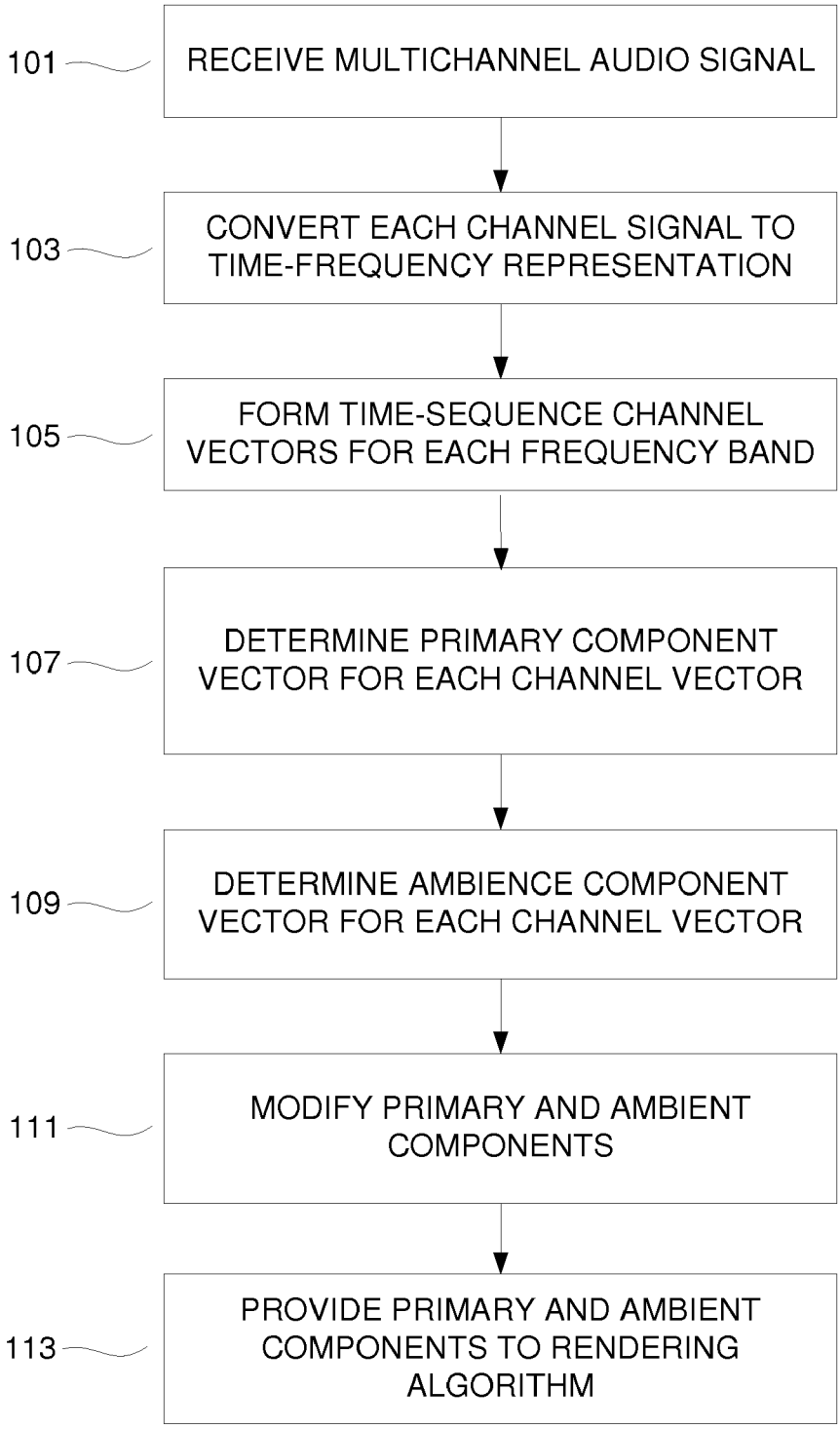
FIG. 1 is a flow chart of a method for primary-ambient decomposition and post-processing in accordance with various embodiments of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

The present invention provides improved primary-ambient decomposition of stereo audio signals or multichannel signals. The proposed methods provide more effective primary-ambient decomposition than previous conventional approaches.

The present invention can be used in many ways to process audio signals. A goal is to separate a mixture of music, for example a 2-channel (stereo) signal, into primary and ambient components. Ambient components refer to natural background audio representative of the recording environment such as reverberation and applause. Primary components refer to discrete, coherent sources; for example, vocals may constitute primary signals.

Primary-ambient decomposition of audio signals is useful for stereo-to-multichannel upmix. The stereo loudspeaker reproduction format consists of front left and front right loudspeakers, whereas standard multichannel formats also include a front center and multiple surround and rear channels; stereo-to-multichannel upmix refers to any process by which signal content for these additional channels for a multichannel reproduction is generated from an input stereo signal. Generally, ambient components are used in stereo-to-multichannel upmix to synthesize surround signals which will result in an increased sense of envelopment for the listener. Primary components are typically used to generate center-channel content to stabilize the frontal audio image and enlarge the listening sweet spot. One approach for center-channel synthesis is to identify only that signal content in the original left and right channels that is center-panned (i.e. equally weighted in the two input channels and intended to be heard as originating from between the two speakers, as is typical for vocals in music tracks), to extract that content from the left and right channels, and then redirect it to the center channel; this approach is referred to as center-channel extraction. Another approach is to identify the panning directions for all of the content in the two input channels, and to reroute the content based on its panning direction so that is rendered by the closest pair of loudspeakers: content panned toward the left in the original stereo is rendered in the multichannel setup using the front left and front center loudspeakers; content originally panned toward the right is rendered in the multichannel setup using the front right and the front center loudspeakers (and content originally panned to the center is rendered using the center loudspeaker); this approach is referred to as pairwise panning.

A vector primary-ambient decomposition model is provided as a framework for deriving improved primary-ambient signal decompositions. Advantages of the present invention over previous methods result from the choice of the unit vectors for the signal model (e.g., in (3)-(4) shown below). Embodiments of the present invention provide more robust choices for the unit vectors. The unit vectors are better adapted to the input signal characteristics.

A first embodiment of the present invention, i.e., the modified PCA primary-ambient decomposition, provides a decomposition that is better adapted to the input signal characteristics than those described by previous methods. This approach yields an improved decomposition than PCA for uncorrelated or weakly correlated input signals by using a correlation-based crossfade as described below.

A second embodiment of the present invention, i.e., the "orthogonal ambience basis expansion" method, derives an orthogonal basis adaptively from the input signals such that the ambience components across channels are always orthogonal. This basis is used in conjunction with the primary unit vector derived by PCA to derive the primary-ambient decomposition for each channel signal. This approach retains the performance of the PCA method for highly correlated signals while improving the performance for weakly correlated signals.

The embodiments of the present invention provide improved performance, e.g. less leakage of primary components into the estimated ambience than in prior methods. Although not required, preferred embodiments include frequency-domain/subband implementations. In preferred embodiments, decompositions are computed using autocorrelation and cross-correlation/inner-product computations.

Mathematical Foundations

The following equations define the relationships between the parameters used in the following analysis methods:

$$r_{LR}=\vec{X}_L^H\vec{X}_R \text{ (correlation)}$$

$$r_{LL}=\vec{X}_L^H\vec{X}_L \text{ (autocorrelation)}$$

$$r_{RR}=\vec{X}_R^H\vec{X}_R \text{ (autocorrelation)}$$

$$r_{LR}(t)=\lambda r_{LR}(t-1)+(1-\lambda)X_L(t)^*X_R(t) \text{ (running correlation, where } X_i(t) \text{ is the new sample at time t of the vector } \vec{X}_i)$$

$$\phi_{LR}=\frac{r_{LR}}{(r_{LL}r_{RR})^{1/2}} \text{ (correlation coefficient)}$$

$$\left(\frac{\vec{X}_R^H\vec{X}_L}{\vec{X}_R^H\vec{X}_R}\right)\vec{X}_R=\left(\frac{r_{LR}^*}{r_{RR}}\right)\vec{X}_R=\text{projection of } \vec{X}_L \text{ onto } \vec{X}_R$$

$$\left(\frac{\vec{X}_L^H\vec{X}_R}{\vec{X}_L^H\vec{X}_L}\right)\vec{X}_L=\left(\frac{r_{LR}}{r_{LL}}\right)\vec{X}_L=\text{projection of } \vec{X}_R \text{ onto } \vec{X}_L$$

When a signal is transformed (e.g. by the STFT), there is a component $X_i[k,m]$ or each transform index k and time index m; in the STFT case, the index m indicates the time location of the window to which the Fourier transform was applied. For each given k, the transform is treated as a vector in time, i.e. samples of $X_i[k, m]$ at a given k and a range of m values are concatenated into a vector representation. In principle, any signal decomposition or time-frequency transformation could be used to generate these subband vectors. It is preferred that a time-frequency representation is used for the subband vectors. However, the scope of the invention is not so limited. Other forms of signal representation may be used including but not limited to time-domain representations of the signals. The vector length is a design parameter: the vectors could be instantaneous values (scalars), in which case the vector magnitude corresponds to the absolute value of a sample; or, the vectors could have a static or dynamic length. Alternately, the vectors and vector statistics could be formed by recursion, in which case the treatment of the signals as vectors is not explicit in the methods: in this case, signal vectors are not explicitly assembled by concatenation of successive samples; but rather (for each channel in each subband) only the current input sample is required (in conjunction with the recursively computed correlations) to compute the current output sample. Those skilled in the relevant arts will recognize that several embodiments of the present invention can be implemented in this way without explicit formation of signal vectors; these implementations are within the scope of the invention in that vector-space methods are implicitly used. It should be noted that a recursive formulation, as in the running correlation $r_{LR}$ above, is useful for efficient inner product calculations such as those needed to compute correlations and is furthermore useful for enabling implementations that do not require explicit formation of signal vectors. Also, it should be noted that orthogonality of vectors in signal space is equivalent to the corresponding time sequences being uncorrelated.

FIG. 1 is a flow diagram depicting primary-ambient decomposition based on vector-space methods in accordance with several embodiments of the present invention. The process begins in step 101 where a multichannel audio signal is received. In step 103, each channel signal is converted into a time-frequency representation, in a preferred embodiment using the STFT. Although the STFT is preferred, the invention is not limited in this regard. That is, the use of other time-frequency transformations and representations is included within the scope of the invention. In step 105, a channel signal vector is formed for each channel and each frequency band in the time-frequency representation by concatenating successive samples of the subband channel signals into vectors. In this way, a channel signal vector represents the evolution in time of the channel signal within a frequency band or subband of the time-frequency representation. In step 107, a primary component vector is determined for each channel vector using vector-space methods such as principal component analysis or a modification thereof (e.g., Modified PCA Primary-Ambient Decomposition; Orthogonal Ambience Basis Expansion). In step 109, the ambience component vector is determined for each channel vector as the difference between the channel vector and the primary component vector, such that the sum of the primary component vector (determined in step 107) and the ambience component vector (determined in step 109) is equal to the original channel vector. Mathematically, this decomposition can be expressed as $$\vec{X}_i[k,m]=\vec{P}_i[k,m]+\vec{A}_i[k,m]$$

where i is a channel index, k is a frequency index, m is a time index, $\vec{X}_i[k, m]$ is the input channel vector, $\vec{P}_i[k, m]$ is the primary component vector, and $\vec{A}_i[k, m]$ is the ambience component vector. In step 111, the primary and/or ambience components of the decomposition are optionally modified; according to several embodiments, these modifications correspond to gains applied to the primary and ambient components. In step 113, the potentially modified components are provided to a rendering algorithm which includes a conversion of the frequency-domain components into time-domain signals. In one embodiment, the modified components are provided to a rendering algorithm without any particularity as to the type of rendering algorithm. That is, in this embodiment, the scope of the invention is intended to cooperate with any suitable rendering algorithm. In some cases, the rendering might just re-add the modified primary and ambient components for playback. In others, it might distribute the components differently to different playback channels.

Primary-Ambient Signal Decomposition

In its simplest form, a primary-ambient decomposition of a stereo signal can be expressed as $$\vec{x}_L=\vec{p}_L+\vec{a}_L \quad (1)$$

$$\vec{x}_R=\vec{p}_R+\vec{a}_R \quad (2)$$

where $\vec{x}_L$ and $\vec{x}_R$ are the left and right channels of the stereo signal, $\vec{p}_L$ and $\vec{p}_R$ are the respective primary components, and $\vec{a}_L$ and $\vec{a}_R$ are the corresponding ambient components.

The vectors $\vec{x}_L$ and $\vec{x}_R$ here could either be the original time-domain audio signals or subband signals in a time-frequency representation, where the latter case is typically preferable in that the time-frequency representation provides some separation or resolution of the signal components. Given the primary-ambient signal model of (1)-(2), then, the task is to estimate the primary and ambient components for each channel signal. The general idea in the model estimation is that primary components in the two channels should be highly correlated (except for the case where a primary source is hard-panned, i.e. present in only one of the channels) and that the ambient components in the two channels should be uncorrelated; furthermore, the primary and ambient components within a single channel should be uncorrelated as well.

These assumptions about the correlation properties stem from concepts in psychoacoustics (in that perception of diffuseness is related to interaural signal decorrelation), room acoustics (in that late reverberation at different points in a room tends to be uncorrelated), and in studio recording practices (wherein uncorrelated stereo reverb is often added in the production process).

In order to improve the performance of primary-ambient decompositions for spatial audio applications, various estimation approaches are provided which, unlike scalar mask methods (wherein the primary and/or ambient components for a given signal are estimated by multiplying the signal by a scalar), satisfy at least some of the target correlation conditions directly in the decomposition. The basic idea is to derive primary and ambient unit vectors for each channel such that the model in (1)-(2) can be further specified as:

$$\vec{x}_L=\rho_L\vec{v}_L+\alpha_L\vec{e}_L \tag{3}$$

$$\vec{x}_R=\rho_R\vec{v}_R+\alpha_R\vec{e}_R \tag{4}$$

where $\vec{v}_L$ and $\vec{v}_R$ are the primary unit vectors, $\vec{e}_L$ and $\vec{e}_R$ are the ambience unit vectors, and where the expansion coefficients $\rho_L$, $\rho_R$, $\alpha_L$ and $\alpha_R$ describe the level and balance of the components. Ideally, according to the assumptions discussed earlier, the unit vectors should satisfy the constraints:

$$\vec{v}_L=\vec{v}_R \tag{5}$$

$$\vec{v}_L^H\vec{e}_L=0 \tag{6}$$

$$\vec{v}_R^H\vec{e}_R=0 \tag{7}$$

$$\vec{e}_L^H\vec{e}_R=0 \tag{8}$$

such that the primary components constitute a common fully correlated source and the various inter-component orthogonality conditions are satisfied. In the first condition, an assumption is made that only a single primary source is active in the two-channel signal; in this light, carrying out such decompositions on the subband signals in a time-frequency representation (such as the short-time Fourier transform) is advantageous in that this source assumption is more likely to be valid on a per-subband basis than for the original time-domain signals. Given that the signals $\vec{x}_L$ and $\vec{x}_R$ define a two-dimensional signal space, it is necessary to consider directions outside of the signal subspace if the three orthogonality conditions (6)-(8) are to be met. This excursion is problematic both in that the decomposition problem is then under-specified and in that the complexity is prohibitive for practical applications in consumer audio devices. For some of the embodiments described in this application, then, the considerations to unit component vectors in the signal subspace are restricted, i.e. utilizing decomposition vectors which can be derived as a linear combination of the original signal vectors. In the various embodiments of the present invention, some of these orthogonality constraints are relaxed given this restriction.

Geometric Decompositions

Signal-space geometry provides a useful visualization of signal decompositions in that the correlation relationships between the various components are immediately evident. In the following sections, several decompositions based on signal-space geometry, focusing on which of the constraints in (5)-(8) are satisfied by the respective approaches. As will become clear, the various approaches are fundamentally defined by how the unit vectors in the primary-ambient signal model are determined.

Figure 2:
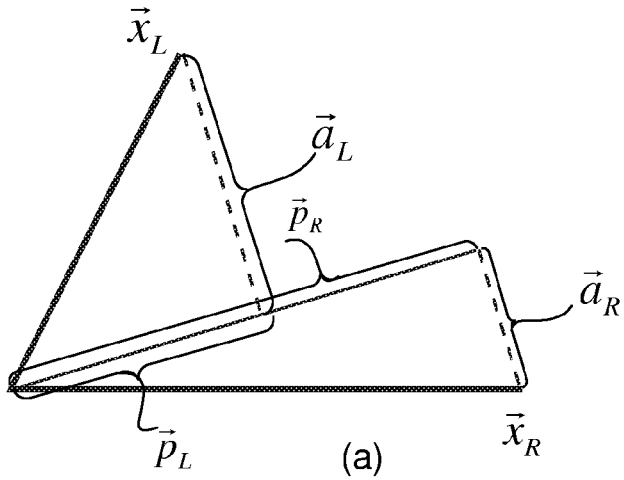
FIG. 2 is a diagram illustrating decomposition of an audio signal into primary and ambient components using principal components analysis in accordance with one embodiment of the present invention.
Figure 2:
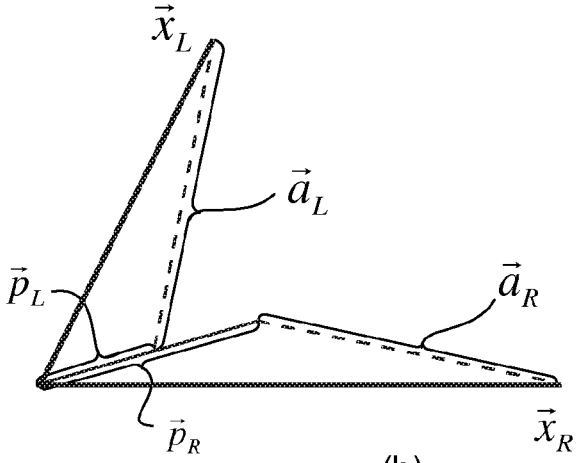
Figure 2:
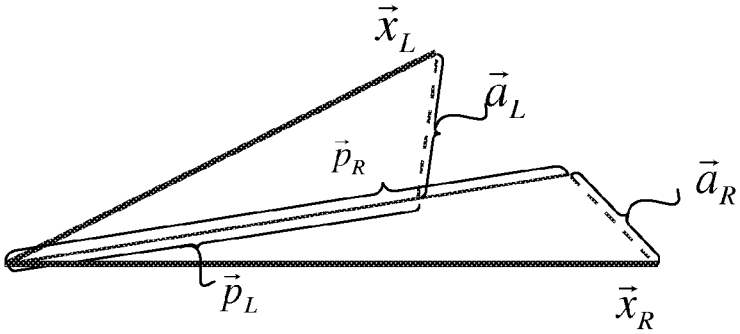

To further elaborate, FIG. 2 is a diagram illustrating decomposition of an audio signal into primary and ambient components using principal components analysis in accordance with one embodiment of the present invention. In FIG. 2(*a*), the primary-ambient decomposition using principal components analysis is performed. In FIG. 2(*b*), the PCA decomposition in FIG. 2(*a*) is modified in accordance with one embodiment of the present invention so as to improve the decomposition of uncorrelated inputs. FIG. 2(*c*) illustrates an example of this modified PCA decomposition for a more strongly correlated signal.

Primary-Ambient Decomposition by Principal Component Analysis

According to various embodiments of the present invention, the primary-ambient decomposition is determined via principal components analysis. PCA is used to find the primary vector which best explains the multichannel input signal content, i.e. which represents the multichannel content with the least total residual energy across all channels (which corresponds to the ambience in this approach). The primary vector determined via PCA is common to all of the channels. The primary components for the various input channels are determined via orthogonal projection onto this common primary vector; the primary components for the various channels are thereby collinear (fully correlated). In the following, a PCA-based algorithm for primary-ambient decomposition of multichannel audio is given and a closed-form solution for the two-channel case is developed.

Figure 3:
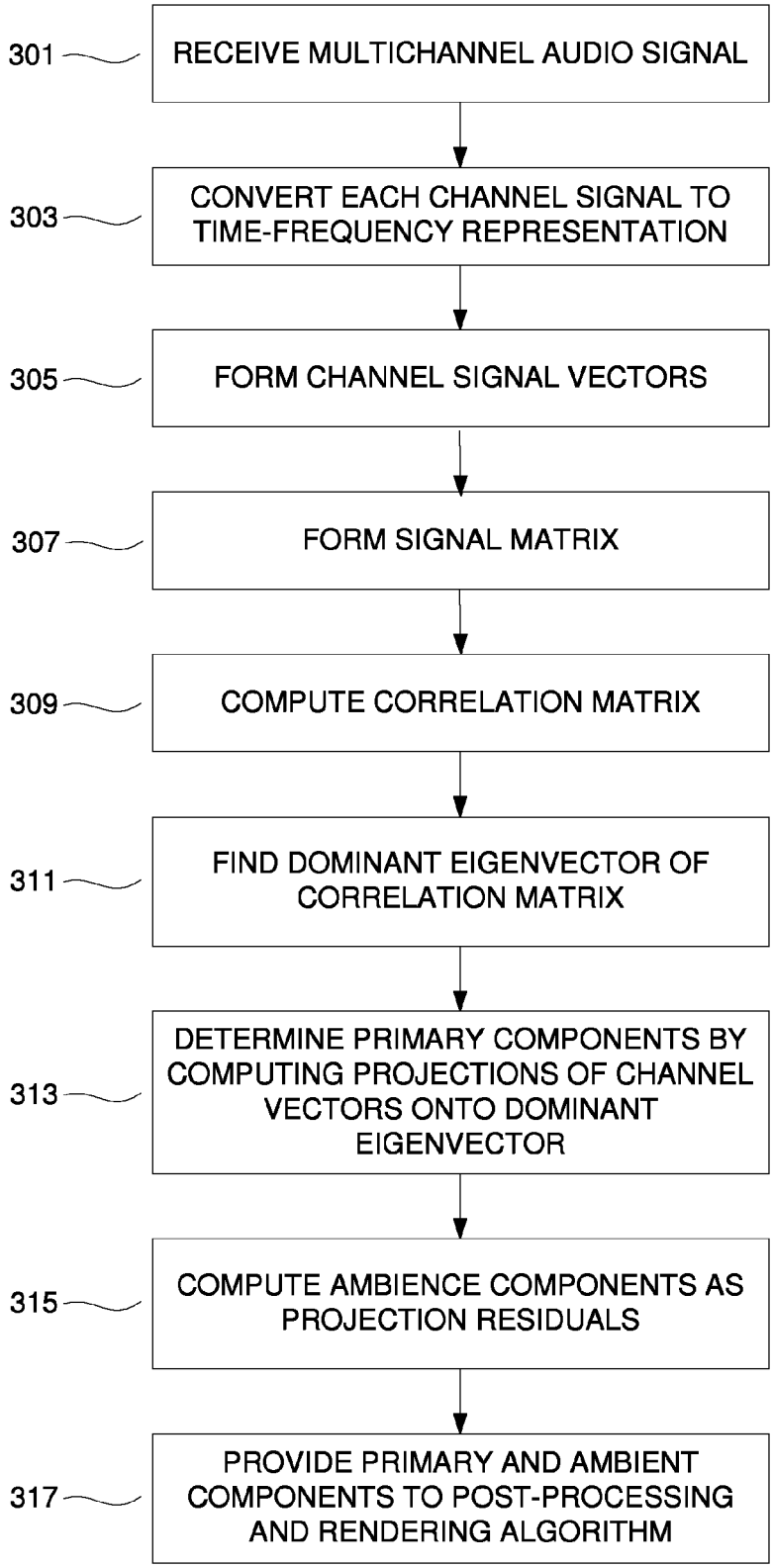
FIG. 3 is a flow chart of a method for primary-ambient decomposition of multichannel audio in accordance with one embodiment of the present invention.

FIG. 3 is a flow chart describing the primary-ambient decomposition of a multichannel audio signal using principal components analysis. The process begins in step 301 where a multichannel audio signal is received. In step 303, the audio channel signals $x_i[n]$ are converted to a time-frequency representation $X_i[k, m]$, e.g. using the STFT. In step 305, the time-frequency channel signals are assembled into channel vectors (by concatenating successive samples); in step 307, a signal matrix whose columns are the channel vectors is formed. The signal correlation matrix is computed in step 309; denoting the signal matrix by X, the correlation matrix is found as $R=XX^H$ where H denotes the conjugate transpose. In step 311, the largest eigenvalue $\lambda_p$ and the corresponding dominant eigenvector $\vec{v}_p$ are determined. This dominant eigenvector corresponds to the "principal component", and it can also be referred to as the "principal eigenvector". In step 313, the orthogonal projection of each channel vector onto the eigenvector $\vec{v}_p$ is computed and identified as the primary component for that channel. In step 315, the ambience component for each channel is computed by subtracting the primary component vector determined in 313 from the original channel vector. Those skilled in the arts will recognize that in some implementations the primary component vector and the ambience component vector can be determined at each sample time m such that explicit formation of primary and ambient component vectors is not required in the implementation; such implementations are within the scope of the invention. In step 317, the primary and ambient components are provided to a post-processing and rendering algorithm which includes a conversion of the frequency-domain primary and ambient components into time-domain signals.

Those skilled in the arts will recognize that step 311 can be carried out by computing a full eigen decomposition and then selecting the largest eigenvalue and corresponding eigenvector or by using a computation method wherein only the dominant eigenvector is determined. For instance, the dominant eigenvector can be approximated effectively and efficiently by selecting an initial vector $\vec{v}_0$ and iterating the following steps:

$$\vec{v}_0 \leftarrow R\vec{v}_0$$

$$\vec{v}_0 \leftarrow \frac{\vec{v}_0}{\|\vec{v}_0\|}$$

As these steps are repeated, the vector $\vec{v}_0$ converges to the dominant eigenvector (the one with the largest eigenvalue), with a faster convergence if the eigenvalue spread of the correlation matrix R is large. This efficient approach is viable since only the dominant eigenvector is needed in primary-ambient decomposition algorithm, and such an approach is preferable in implementations where computational resources are limited since determining a full explicit eigen decomposition can be computationally costly. A practical starting value for $\vec{v}_0$ is the column of X with the largest norm, since that will dominate the principal component computation. Those skilled in the relevant arts will recognize that other methods for computing the principal component could be used. The current invention is not limited to the methods disclosed here; other methods for determining the dominant eigenvector are within the scope of the invention.

Figure 4:
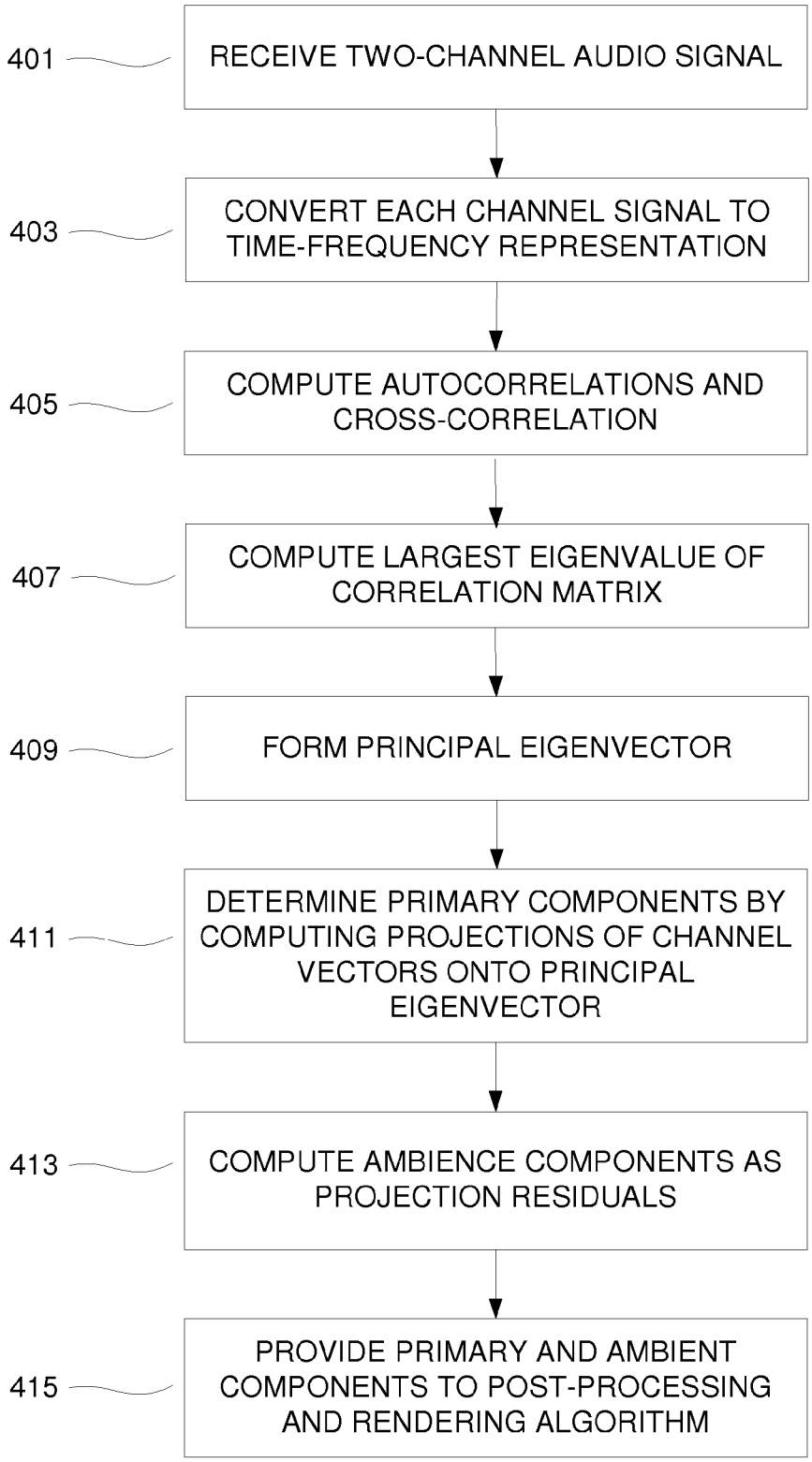
FIG. 4 is a flow chart of a method for primary-ambient decomposition of two-channel audio in accordance with one embodiment of the present invention.

For the two-channel case, the current invention provides a simple closed-form solution such that explicit eigen decomposition or iterative eigenvector approximation methods are not required. FIG. 4 provides a flow chart for primary-ambient decomposition of two-channel audio signals using principal components analysis. The process begins in step 401 where a two-channel audio signal is received. In step 403, the audio channel signals are converted to a time-frequency representations $X_L[k, m]$ and $X_R[k, m]$, e.g. using the STFT. In step 405, the cross-correlation $r_{LR}[k,m]$ and auto-correlations $r_{LL}[k,m]$ and $r_{RR}[k,m]$ are computed, in a preferred embodiment by the recursive inner product computation method described earlier. In step 407, the largest eigenvalue of the signal correlation matrix is computed according to $$\lambda[k, m] = \frac{1}{2}\begin{pmatrix} r_{LL}[k, m] + \\ r_{RR}[k, m] \end{pmatrix} + \frac{1}{2}\begin{bmatrix} (r_{LL}[k, m] - r_{RR}[k, m])^2 \\ +4|r_{LR}[k, m]|^2 \end{bmatrix}^{\frac{1}{2}}.$$

In this method, the computation of the largest eigenvalue of the correlation matrix can be carried out directly using the correlation quantities computed in step 405 and does not require explicit formation of channel vectors, a signal matrix, or a correlation matrix. In step 409, the principal component vector is formed according to $$\vec{v}[k,m]=r_{LR}[k,m]\vec{X}_L[k,m]+(\lambda[k,m]-r_{LL}[k,m])\vec{X}_R[k,m].$$

In some embodiments, this principal component vector may be normalized in step 409 although this is not explicitly required. In step 411, the primary components are determined by projecting the input signal vectors on the principal eigenvector according to $$\vec{P}_L[k, m] = \left(\frac{r_{vL}[k, m]}{r_{vv}[k, m]}\right)\vec{v}[k, m]$$

$$\vec{P}_R[k, m] = \left(\frac{r_{vR}[k, m]}{r_{vv}[k, m]}\right)\vec{v}[k, m]$$

where $$r_{vL}[k, m] = \vec{v}[k, m]^H \vec{X}_L[k, m]$$

$$r_{vR}[k, m] = \vec{v}[k, m]^H \vec{X}_R[k, m]$$

$$r_{vv}[k, m] = \vec{v}[k, m]^H \vec{v}[k, m]$$

and where the division by $r_{vv}[k,m]$ is protected against singularities. If $r_{vv}[k,m]$ is below a certain threshold, the primary component (for that k and m) is assigned a zero value. In step 413, the ambience components are computed by subtracting the primary components derived in step 411 from the original signals according to:

$$\vec{A}_L[k,m]=\vec{X}_L[k,m]-\vec{P}_L[k,m]$$

$$\vec{A}_R[k,m]=\vec{X}_R[k,m]-\vec{P}_R[k,m]$$

Those skilled in the arts will recognize that in some implementations the primary component vector and the ambience component vector can be determined at each sample time m such that explicit formation of primary and ambient component vectors is not required in the implementation; such sample-by-sample implementations are within the scope of the invention. In step 415, the primary and ambient components are provided to a post-processing and rendering algorithm which includes a conversion of the frequency-domain primary and ambient components into time-domain signals.

Those skilled in the arts will understand that the projection of the signal onto the principal component in step 411 could be implemented in a number of ways, for instance by expressing the autocorrelation $r_{vv}$ in a closed form based on other quantities. The current invention is not limited with regard to the manner of computation of the projection of the signals onto the primary component; any computational method to derive this projection is within the scope of the invention. In some implementations it may be preferable to use the approach described above for the sake of computational efficiency.

Figure 5:
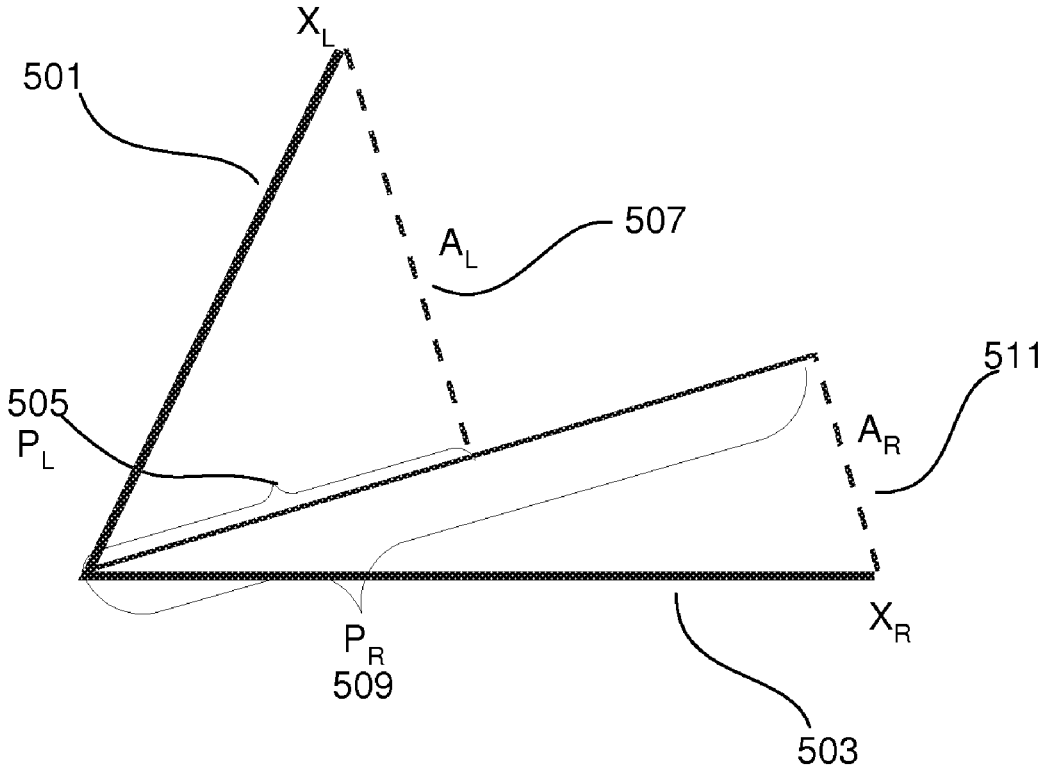
FIG. 5 is a diagram illustrating vector-space decomposition in accordance with one embodiment of the present invention.

FIG. 5 is a vector diagram illustrating primary-ambient decomposition based on principal components analysis. Signal vector 501 is decomposed into primary component 505 and ambience component 507, and signal vector 503 is decomposed into primary component 509 and ambience component 511. As the diagram illustrates, the ambience component 507 is orthogonal to the primary component 505, and the ambience component 511 is orthogonal to the primary component 509. Furthermore, the primary components 505 and 509 are collinear.

The PCA decomposition satisfies the primary commonality constraint (5) and the primary-ambient orthogonality conditions (6)-(7) by construction. However, the constraint (8) is violated in that the estimated ambience components are actually collinear (with a negative correlation). Furthermore, when the input signals are not highly correlated (and the primary dominance assumption does not hold), the PCA approach overestimates the primary component in the decomposition. While the PCA method provides a perceptually compelling primary component for many natural audio signals, it is necessary to address these shortcomings in a general algorithm. In the following sections, corrective methods which leverage the PCA primary component estimation but improve the decomposition for weakly correlated signals are described.

Modified PCA Primary-Ambient Decomposition

The PCA-based primary-ambient decomposition relies on the assumption that the primary component is dominant. When this is the case, as in many audio recordings, the primary component extraction is perceptually compelling. However, the PCA decomposition generally underestimates the amount of ambience energy, most markedly when the two channels are uncorrelated (and there is no true primary component); instead of identifying both channels as ambient, it selects the higher-energy channel as the principal component (which corresponds to the primary unit vector in the decomposition) and the lower-energy channel as the secondary component (which corresponds to the ambience unit vector). The PCA is thus clearly valid only when the dominance assumption holds, i.e. when the correlation coefficient between the two channel signals, denoted as $|\phi_{LR}|$, is close to one. As $|\phi_{LR}|$ approaches zero, the primary-ambient decomposition would indeed be better estimated by considering the signal to be entirely ambient. This observation suggests an ad hoc modification of the PCA decomposition:

$$\vec{x}_L=|\phi_{LR}|(\rho_L\vec{v}_L+\alpha_L\vec{e}_L)+(1-|\phi_{LR}|)\vec{x}_L \tag{9}$$

$$\vec{x}_L=|\phi_{LR}|\rho_L\vec{v}_L+|\phi_{LR}|\alpha_L\vec{e}_L+(1-|\phi_{LR}|)\vec{x}_L \tag{10}$$

$$\vec{x}_R=|\phi_{LR}|\rho_R\vec{v}_R+|\phi_{LR}|\alpha_R\vec{e}_R+(1-|\phi_{LR}|)\vec{x}_R \tag{11}$$

where the first term in (10) and (11) corresponds to the respective modified primary components and the latter two terms in (10) and (11) correspond to the respective modified ambient components. Using (3) and (4) and carrying out some algebraic manipulations yields expressions for the modified primary and ambience components in terms of the original components:

$$\vec{p}_L'=|\phi_{LR}|\vec{p}_L$$

$$\vec{a}_L'=|\phi_{LR}|\vec{a}_L+(1-|\phi_{LR}|)\vec{p}_L$$

$$\vec{p}_R'=|\phi_{LR}|\vec{p}_R$$

$$\vec{a}_R=|\phi_{LR}|\vec{a}_R+(1-|\phi_{LR}|)\vec{p}_R.$$

The modification thus adjusts the balance between the primary and ambience components by reassigning some of the original primary component to the ambience component for each channel.

An example of this modified PCA decomposition is depicted in FIG. 2(*b*), where it should be clear that the estimated ambience components are significantly less correlated than in the PCA decomposition of FIG. 2(*a*). Informal listening tests indicate that this approach provides an improvement over PCA for synthetic test signals and typical music audio. The modified PCA approach yields a better decomposition than PCA for uncorrelated or weakly correlated input signals.

Orthogonal Ambience Basis Expansion

Figure 6:
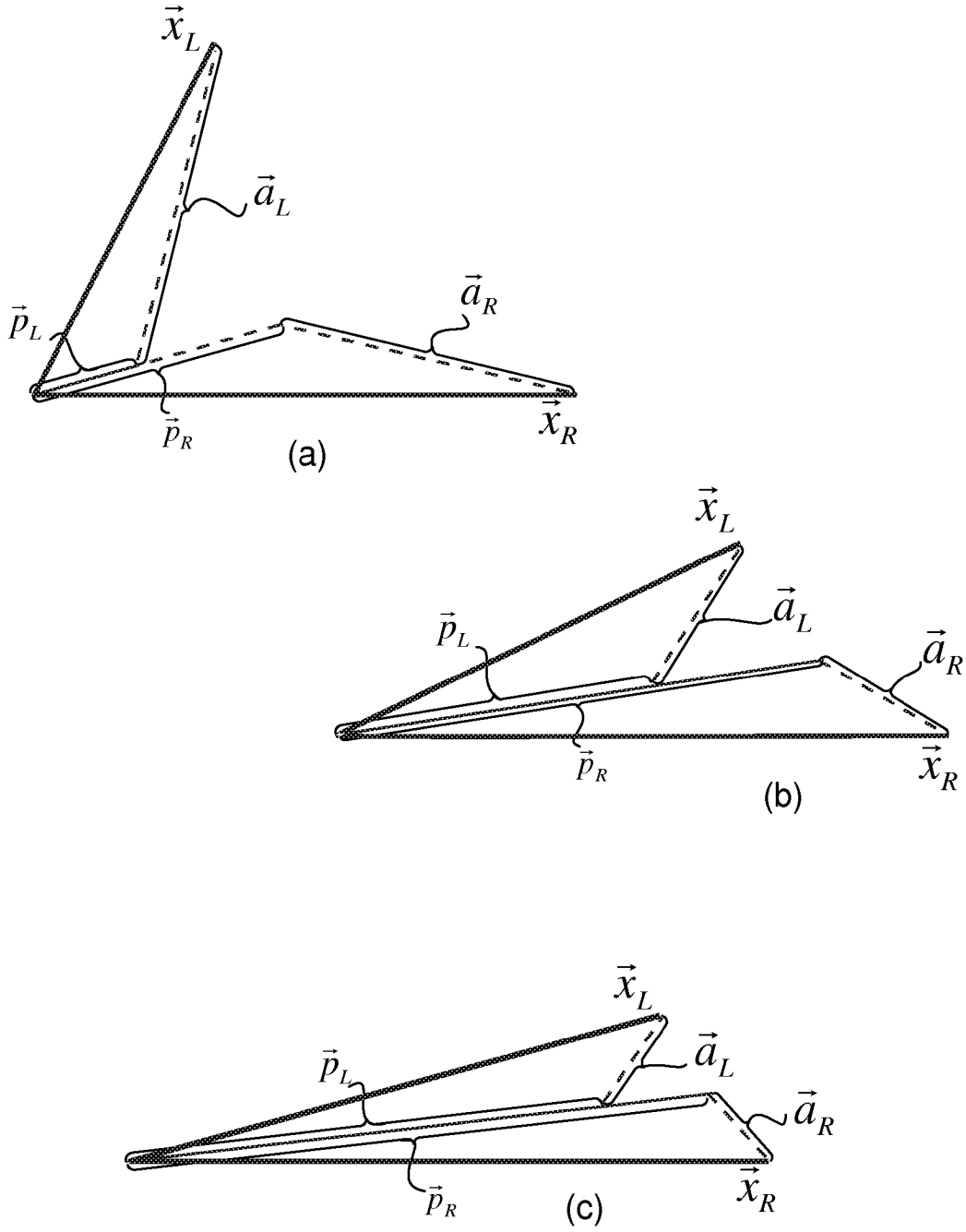
FIG. 6 is a diagram illustrating decomposition of an audio signal into primary and ambient components using a signal-adaptive orthogonal ambience basis and a primary unit vector derived by principal components analysis in accordance with one embodiment of the present invention.

FIG. 6 is a diagram illustrating decomposition of an audio signal into primary and ambient components using a signal-adaptive orthogonal ambience basis and a primary unit vector derived by principal components analysis in accordance with one embodiment of the present invention.

The embodiments described previously do not provide a decomposition that explicitly satisfies the inter-channel ambience orthogonality condition in (8). An alternative embodiment ensures that the ambience components are always orthogonal by directly constructing the ambience unit vectors to be orthogonal, i.e. to constitute an orthonormal basis for the signal subspace. The basis is derived such that $$\frac{\vec{e}_L^H\vec{x}_L}{\|\vec{x}_L\|}=\frac{\vec{e}_R^H\vec{x}_R}{\|\vec{x}_R\|} \tag{12}$$

which ensures that the ambience basis functions are not biased with respect to either of the input signals. Furthermore, if the input signals are fully uncorrelated, the ambience unit vectors will be found as normalized versions of the signals themselves.

The ambience basis derivation consists of two steps: first, an orthogonal basis for the signal subspace is constructed using a Gram-Schmidt process:

$$\vec{g}_L=\frac{\vec{x}_L}{\|\vec{x}_L\|} \tag{13}$$

$$\vec{g}_R=\vec{x}_R-(\vec{g}_L^H\vec{x}_R)\vec{g}_L \tag{14}$$

where $\vec{g}_R$ is subsequently normalized. Then, the ambience unit vectors are determined by rotating the Gram-Schmidt basis:

$$[\vec{e}_L\ \ \vec{e}_R]=\frac{1}{(1+|\gamma|^2)^{1/2}}[\vec{g}_L\ \ \vec{g}_R]\begin{bmatrix}1 & -\gamma^*\\ \gamma & 1\end{bmatrix} \tag{15}$$

where $$\gamma=\frac{1}{\phi_{LR}}\left[-1+(1-|\phi_{LR}|^2)^{1/2}\right] \tag{16}$$

is used; this choice of γ rotates the Gram-Schmidt basis such that the resulting ambience unit vectors $\vec{e}_L$ and $\vec{e}_R$ satisfy the condition in (12). After the ambience basis is derived, each channel is decomposed using the corresponding ambience unit vector and a primary unit vector derived via PCA; the PCA unit vector is retained in this algorithm due to its robust performance for correlated (i.e. mostly primary) input signals.

The expansion coefficients are given by $$\begin{bmatrix}\rho_L\\ \alpha_L\end{bmatrix}=([\vec{v}\ \ \vec{e}_L]^H[\vec{v}\ \ \vec{e}_L])^{-1}[\vec{v}\ \ \vec{e}_L]^H\vec{x}_L \tag{17}$$

$$\begin{bmatrix}\rho_R\\ \alpha_R\end{bmatrix}=([\vec{v}\ \ \vec{e}_R]^H[\vec{v}\ \ \vec{e}_R])^{-1}[\vec{v}\ \ \vec{e}_R]^H\vec{x}_R \tag{18}$$

which can be simplified as $$\rho_L=\frac{\vec{v}^H\vec{x}_L-(\vec{v}^H\vec{e}_L)(\vec{e}_L^H\vec{x}_L)}{1-|\vec{v}^H\vec{e}_L|^2} \tag{19}$$

$$\alpha_L=\frac{\vec{e}_L^H\vec{x}_L-(\vec{e}_L^H\vec{v})(\vec{v}^H\vec{x}_L)}{1-|\vec{v}^H\vec{e}_L|^2} \tag{20}$$

and similarly for $\rho_R$ and $\alpha_R$. If the input signals are not correlated, the ambience basis expansion coefficients $\alpha_L$ and $\alpha_R$ will be dominant, whereas if the input signals are highly correlated, the primary coefficients will be dominant. This can be viewed as a formalization of the modification described in an earlier embodiment in (9)-(11), with the distinction that the ambience component orthogonality is always ensured here. Several examples of signal decomposition using this orthogonal ambience basis approach are illustrated in FIG. 6; note that the ambience components are orthogonal in all cases.

Other Embodiments

In other embodiments, modifications may be based on the generated decomposition. The primary and ambient components can be individually modified to achieve desired effects. For example, the ambience components are enhanced in several embodiments. In one, the ambience components are boosted and added back to original primary components. In another embodiment, the ambience components are enhanced to achieve a reverberation effect/stereo widening. In accordance with other embodiments, suppression of ambience components takes place. For example, in one, the ambience components are attenuated and added back to original primary components. Such suppression is used also for a dereverberation effect.

In further embodiments, enhancement or suppression of primary components is implemented. For example, in one embodiment, the primary components are boosted and added back to the original ambience. In another embodiment, the primary components are attenuated (suppressed) and added back to original ambience. Suppression of primary components decomposed in accordance with the techniques described earlier is used in one embodiment for reducing voice components for karaoke applications.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for processing a multichannel audio signal to determine primary and ambient components of the signal, the method comprising:

converting each channel of the multichannel audio signal to corresponding subband vectors, wherein the vectors comprise a time sequence or history of the channel signal's behavior in corresponding subbands;

determining a primary component unit vector for each subband;

determining primary component vectors for each audio channel in each subband by projecting the channel subband vector onto the primary component unit vector;

determining the ambience component vector for each channel in each frequency subband as the projection residual; and adjusting the balance between the primary and ambient vectors to generate modified primary and ambient components.

2. The method as recited in claim 1, wherein the primary component unit vector for each subband is determined by a principal component analysis of the corresponding subband channel vectors.

3. The method as recited in claim 1, wherein the balance is adjusted in accordance with a measure of the dominance of the primary component.

4. The method as recited in claim 3, wherein the balance is adjusted such that when the measure of the dominance of the primary component approaches zero, the primary and ambient components are modified to conform with an estimation that the signal is entirely ambient.

5. The method as recited in claim 3, wherein the measure of the dominance of the primary component corresponds to the correlation coefficient between the channel subband vectors.

6. The method as recited in claim 1, wherein the balance is adjusted so as to achieve a desired effect on the reconstructed audio signal.

7. The method as recited in claim 6, wherein the balance is adjusted so as to attenuate the ambience component with respect to the primary component.

8. The method as recited in claim 6, wherein the balance is adjusted so as to magnify the ambience component with respect to the primary component.

9. The method as recited in claim 1, wherein the balance between the primary and ambient vectors is adjusted by reassigning some of the primary component to the ambience component for each channel.

10. The method as recited in claim 1, wherein the multichannel audio signal is a two-channel audio signal.

11. A method for processing a multichannel audio signal to determine primary and ambient components of the signal, the method comprising:

converting each channel of the multichannel audio signal to corresponding subband vectors, wherein the vectors comprise a time sequence or history of the channel signal's behavior in corresponding subbands;

determining ambience unit vectors for each channel and each subband after forming an orthogonal basis for the signal subspace defined by the corresponding channel subband vectors;

determining a primary component unit vector for each subband; and decomposing the subband vector for each channel using the corresponding ambience unit vector and the primary unit vector.

12. The method as recited in claim 11, wherein the primary component unit vector for each subband is determined by a principal component analysis of the corresponding subband channel vectors.

13. The method as recited in claim 11, wherein the orthogonal basis for the signal subspace defined by the channel subband vectors is derived at least in part by a Gram-Schmidt orthogonalization of the channel subband vectors.

14. The method as recited in claim 11, wherein the orthogonal basis for the signal subspace defined by the channel subband vectors is configured to correspond to the unit vectors defined by the channel subband vectors in the case that the channel subband vectors are uncorrelated.

15. The method as recited in claim 11, wherein the multichannel audio signal is a two-channel audio signal.

* * * * *